United States Patent [19]

Pellegrino

[11] Patent Number: 4,577,404

[45] Date of Patent: Mar. 25, 1986

[54] CONNECTOR POLARIZATION METHOD

[75] Inventor: Thomas P. Pellegrino, Lisle, Ill.

[73] Assignee: Molex Incorporated, Lisle, Ill.

[21] Appl. No.: 761,321

[22] Filed: Jul. 29, 1985

Related U.S. Application Data

[63] Continuation of Ser. No. 555,852, Nov. 28, 1983, abandoned.

[51] Int. Cl.[4] ..... H01R 43/16

[52] U.S. Cl. ..... 29/874; 339/220 R

[58] Field of Search ..... 29/747, 874; 264/296, 264/320, 339; 339/184 R, 184 M, 220 R

[56] References Cited

U.S. PATENT DOCUMENTS 3,993,396 11/1976 Eigenbrode ..... 339/220 R 4,092,058 5/1978 Eigenbrode ..... 29/874 X

*Primary Examiner*—Howard N. Goldberg

*Assistant Examiner*—Carl J. Arbes

*Attorney, Agent, or Firm*—Louis A. Hecht; Bruce R. Mansfield

[57] ABSTRACT

A method of polarizing a female pin conductor receiving connector and an apparatus for performing said method. The female connector has a plurality of pin receiving openings formed in the housing thereof so that a pin conductor may be received therethrough for mating with a terminal mounted inside the housing. The polarizing method comprises deforming a portion of the housing adjacent the pin receiving opening to define a deformed section whereby the opening is substantially closed by the deformed section to prevent a pin conductor from being received therethrough. The apparatus includes means for holding the connector in a given disposition and punch means having an end engageable with the housing for deforming and moving a portion thereof in order to close the opening.

3 Claims, 5 Drawing Figures

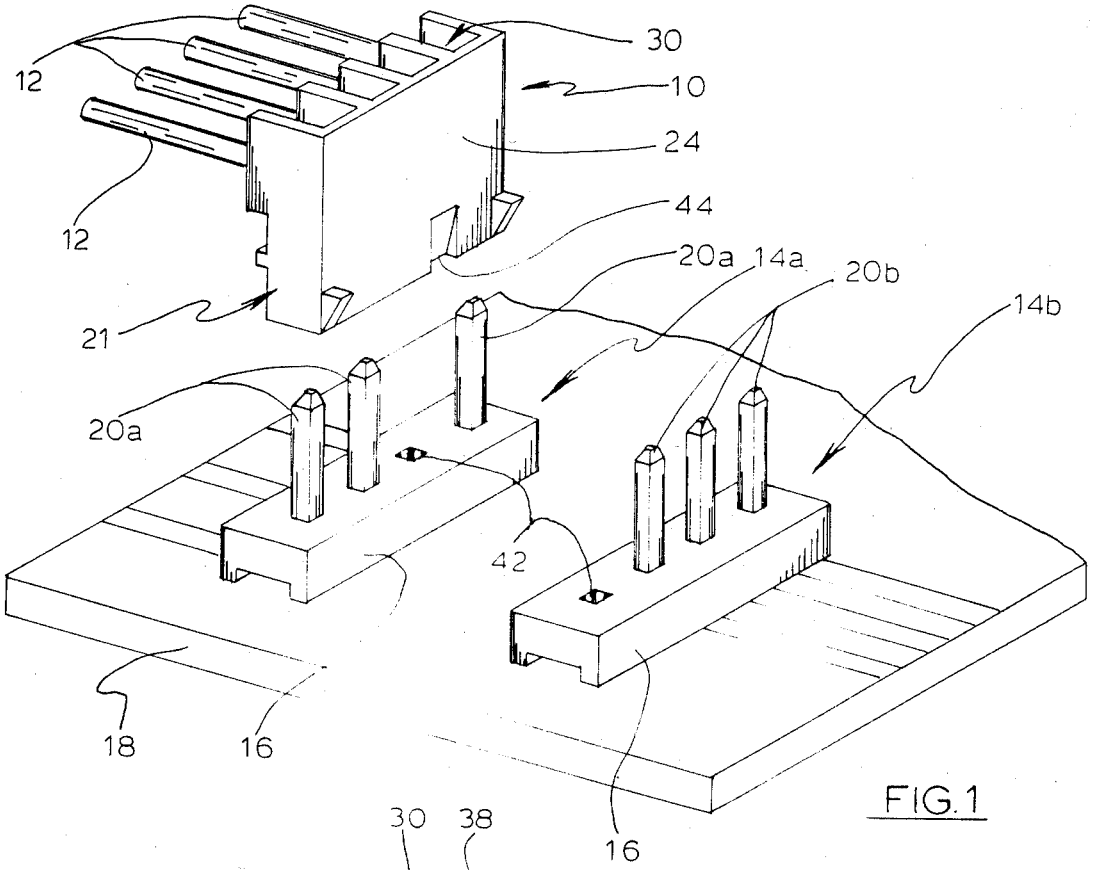
FIG. 1
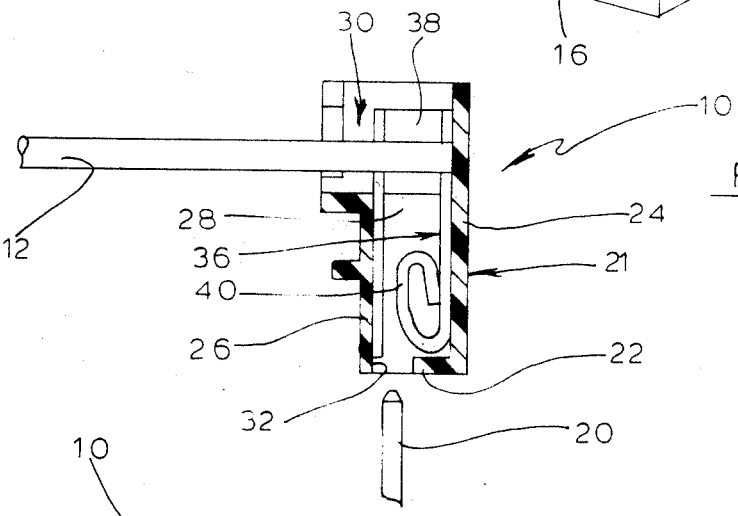
FIG. 2
FIG. 3
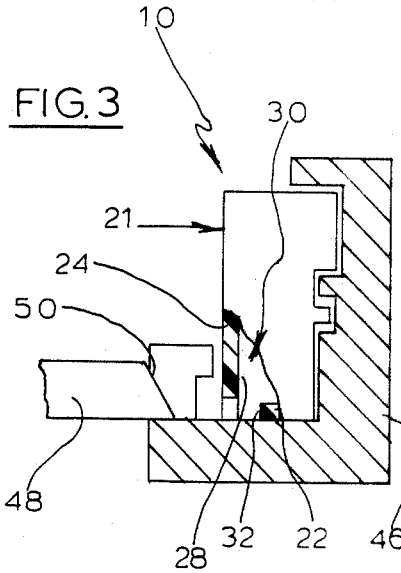
FIG. 4
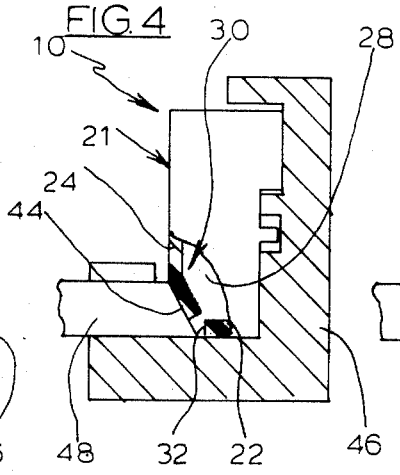
FIG. 5
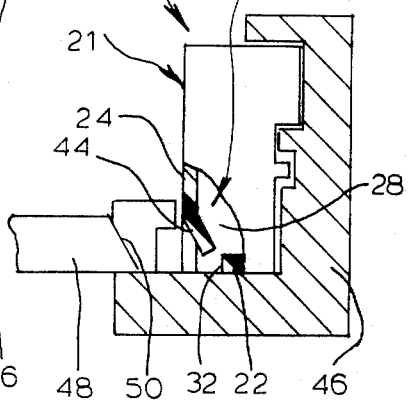

CONNECTOR POLARIZATION METHOD

This application is a continuation of application Ser. No. 555,852 filed Nov. 28, 1983 now abandoned.

BACKGROUND OF THE INVENTION

1. Field of the Invention

The present invention generally relates to a female pin conductor receiving connector and, in particular, to a method and apparatus for polarizing such a connector.

2. Brief Description of the Prior Art

Pin conductors have long been used as a means of providing a male terminal which is mateable with a female connector. Most commonly the pin conductors are arranged in a single row or double rows with the conductors staked into a printed circuit board, mounted on a water or mounted on a header.

The female connector generally includes a housing having an exterior end wall, a pair of opposing parallel exterior side walls extending from opposite edges of the end wall and a plurality of terminal receiving cavities formed between said side walls and the end wall. Each cavity has a pin receiving opening formed in the end wall. A plurality of terminals are mounted in some or all of the cavities. Each terminal has a portion that is mateable with a pin conductor when the pin conductor is received through the corresponding opening.

It is often desirable to polarize the female connector so that it will only fit on a certain array of pin conductors. This is normally done by blocking the pin receiving opening of the female connector so that said blocked opening corresponds with a missing pin conductor in a straight line array of conductors. In this manner, only the female connector having the blocked opening in the same position as the missing conductor will fit on that particular array of pin conductors.

In the past, the pin receiving opening would be blocked by one of two methods. The first method is to mold the opening shut when the housing is initially manufactured. The other method is to manufacture a small plug which is inserted into a pin receiving opening after manufacture of the connector housing. Both of these methods have proved to be extremely inefficient and relatively expensive. The first method is undesireable because it requires a mold tool change for each particular female connector housing. The second method overcomes the first method's drawbacks, however, at the cost of producing an additional part.

SUMMARY OF THE INVENTION

It is, therefore, the principal object of the present invention to provide a new and improved method and apparatus for polarizing a female pin conductor receiving connector.

The female connector includes a housing having an exterior end wall, a pair of opposing parallel exterior sidewalls extending from opposite edges of the end wall, and a plurality of terminal receiving cavities formed between said side walls and the end wall, each cavity having a pin receiving opening formed in the end wall. A plurality of terminals are mounted in some or all of said cavities, each terminal having a portion that is mateable with a pin conductor when it is received through the corresponding opening.

The polarizing method comprises the steps of:

deforming a portion of the housing adjacent a pin receiving opening to define a deformed section whereby the end wall opening is substantially closed by the deformed section to prevent a pin conductor from being received therethrough.

The apparatus for performing said method comprises:

means for holding said connector in a given disposition; and punch means having an end engageable with a portion of the housing adjacent a pin receiving opening for deforming and moving said portion whereby the pin receiving opening is substantially closed to prevent a pin conductor from being received therethrough.

BRIEF DESCRIPTION OF THE DRAWINGS

FIG. 1 is a perspective view of a female pin conductor receiving connector modified in accordance with the method and apparatus of the present invention and two wafers;

FIG. 2 is a side sectional view of a terminal receiving cavity of the female connector shown in FIG. 1; and FIGS. 3, 4 and 5 are sequential sectional views of a female pin conductor receiving connector mounted in the apparatus of the present invention and defining the method of the present invention.

DESCRIPTION OF THE PREFERRED EMBODIMENT

Turning now to the drawings, FIG. 1 shows a female pin conductor receiving connector, generally designated 10. Connector 10 is adapted to electrically connect a plurality of wires 12 with one of a plurality of wafers, generally designated 14A and 14B.

Each wafer comprises an insulative base 16 which is mountable on a printed circuit board 18 and has a group of pin conductors 20A and 20B mounted in and extending from the base 16 in a straight line. It is to be noted that pin connectors other than wafers can be used in association with connector 10.

The female connector 10 has a housing 21 which includes an exterior end wall 22 and two parallel spaced apart exterior side walls 24 and 26 extending from the edges of the end wall 22. A plurality of barrier walls 28 extend between the sidewalls 24 and 26 to define with the end wall 22 a plurality of terminal receiving cavities 30. Each cavity 30 has a pin receiving opening 32 formed in the end wall 22 as a means of allowing a pin conductor 20 to be received within in a particular cavity 30.

Each of the cavities is capable of mounting a terminal, generally designated 36 (FIG. 2), therein. Each terminal has a wire connecting portion 38 at one end and a pin mateable portion 40 formed at the other end. Looking at FIG. 2, the wire connecting portion 38 is seen to be an insulation displacement section that is well known in the art and the pin mateable portion 40 is seen to be a loop-shaped, double cantilevered configuration also well known in the art. It is understood that there are other wire connecting portions 38 and pin mateable portions 40 known in the art that would serve the same purposes as set forth herein.

Looking at FIG. 1, both wafers 14A and 14B have three pin conductors 20A and 20B, respectively. Also, each wafer 14A and 14B has a blank position 42A and 42B, respectively, wherein a pin conductor could have been mounted but was not. Positions 42A and 42B are purposely left blank as a means of polarizing or keying a particular female connector 10 with a particular wafer 14A or 14B.

In order to insure that the correct female connector 10 is mounted on the correct wafer 14A or 14B, the pin receiving opening 32 corresponding with the blank position 42 is closed to prevent a pin conductor 20 from being received therethrough. In the past, this has been accomplished by either molding the opening shut or inserting a small plug by hand within the opening. These two methods are expensive and inefficient.

According to the present invention, a portion of the housing 21 adjacent a desired opening 32 is modified to produce a deformed section 44. The deformed section 44 is a portion of side walls 24 which is pushed toward the opposite side wall 26 so that it at least partially blocks terminal receiving cavity 30. In this configuration, a pin conductor 20 cannot be received through opening 32. Thus, looking at FIG. 1, female connector 10 will only be mateable with wafer 14A and not wafer 14B.

In order to produce a deformed section 44 as described above, the connector 10 is held in a suitable connector nest 46 as shown in FIG. 3. The nest 46 can be of a type that is disclosed in U.S. patent application Ser. No. 422,867 which is owned by the Assignee of the present invention. However, any connector holding means which presents side wall 24 is acceptable.

After connector 10 is held in nest 46, a punch 48 is provided having an end 509 which is engageable with the housing 21 to produce the deformed section 44. The end 50 of punch 48 has a slanted surface formed thereat.

In FIG. 4, the punch 48 has been actuated by suitable means so that the end 50 engages side wall 24 moving a portion thereof toward sidewall 26 producing deformed section 44. In FIG. 5 punch 48 has been retracted.

We claim:

1. A method of selectively polarizing a female connector with respect to one of a plurality of arrays of mating pin conductors comprising the steps of:

mounting a plurality of pin conductors to form said arrays, each array including a plurality of pin locations in a row, at least some of said positions having pin conductors mounted thereat and other of said positions defining blank positions;

providing a female connector including a housing having an exterior end wall, a pair of opposing parallel spaced apart exterior side walls extending from opposite edges of the end wall, and a plurality of terminal receiving cavities formed between said side walls and the end wall, each cavity having a pin receiving opening formed in the end wall alignable with and corresponding to the pin locations of the arrays, and a plurality of female pin receiving terminals mounted in at least some of said cavities adjacent the opening to receive a corresponding pin conductor therethrough; and deforming the female connector housing to form individual deformed sections blocking only the pin receiving openings corresponding to the blank positions of a particular pin array.

2. The method of claim 1 wherein said moving step includes transversely punching the side wall.

3. The method of claim 1 wherein said deforming step includes pushing the housing side wall adjacent the blocked openings at the juncture with the end wall and moving said side wall toward the outer side wall.

* * * * *